United States Patent [19]

Rogers et al.

[11] Patent Number: 4,863,126

[45] Date of Patent: Sep. 5, 1989

[54] THEATER CURTAIN FRAME ASSEMBLY AND STORAGE ASSEMBLY

[75] Inventors: Orley D. Rogers, Farwell; Kenneth E. Staten, Clare, both of Mich.

[73] Assignee: Stageright Corporation, Clare, Mich.

[21] Appl. No.: 227,055

[22] Filed: Aug. 1, 1988

[51] Int. Cl.[4] ..... E04H 3/10

[52] U.S. Cl. ..... 248/158; 403/386; 52/6

[58] Field of Search ..... 248/121, 165, 159, 558, 248/49, 122, 129, 161, 413, 158, 157, 176, 177, 178; 182/181, 182; 211/189; 446/82, 478; 297/248, 249; 52/126.5, 126.6, 693, 694, 6, 7, 143; 403/386, 384, 364

[56] References Cited

U.S. PATENT DOCUMENTS

| | | | |
|---|---|---|---|
| 3,117,760 | 1/1964 | Dresbach | 248/157 |
| 3,383,738 | 5/1968 | Fox | 297/248 |
| 3,697,130 | 10/1972 | Barecki | 297/248 |
| 3,930,349 | 1/1976 | Wellershaus | 52/694 |
| 3,955,787 | 5/1976 | Brown | 248/159 |
| 4,026,076 | 5/1977 | Analetto | 52/7 |
| 4,386,678 | 6/1983 | Wendell | 182/182 |
| 4,392,627 | 7/1983 | van den Broek | 248/176 |
| 4,512,117 | 4/1985 | Lange | 52/6 |
| 4,638,604 | 1/1987 | Rogers | 182/152 |

FOREIGN PATENT DOCUMENTS

| | | | |
|---|---|---|---|
| 828246 | 2/1960 | United Kingdom | 297/248 |
| 2094139 | 9/1982 | United Kingdom | 297/248 |
| 2103476 | 2/1983 | United Kingdom | 297/248 |

*Primary Examiner*—Alvin C. Chin-Shue
*Assistant Examiner*—Robert A. Olson
*Attorney, Agent, or Firm*—Barnes, Kisselle, Raisch, Choate, Whittemore & Hulbert

[57] ABSTRACT

A staging system including curtains, for use particularly around a portable stage unit, which includes movable support towers. A base on each tower is arranged to interlock with an adjacent base for convenience in transporting and compact storage. Horizontal trusses are provided to intergage endwise and be supported on and between support towers. For operative use the trusses are supported on the top elements of the towers. For storage, trusses or tubular supports are mounted on side support elements of the adjacent towers. The trusses or tubular supports have rails or slots, respectively, for supporting stationary and movable curtains to enclose a stage unit.

5 Claims, 4 Drawing Sheets

THEATER CURTAIN FRAME ASSEMBLY AND STORAGE ASSEMBLY

FIELD OF INVENTION

Portable theater curtain stands and frame designed for operative assembly and compact storage.

BACKGROUND AND OBJECTS OF THE INVENTION

In many schools, churches and entertainment halls it is not economical to have permanent stage installations because of space limitations. There is, however, a need to have staging on certain occasions for amateur plays, musical groups and similar stage events. This can be accomplished with portable and storable raised stage panels which are suitably mounted to provide a platform for a presentation. U.S. Pat. No. 4,638,604 issued January 27, 1987 discloses staging of this nature.

It is also desirable to enclose the staging to present side and back drop curtains as will as a curtain which may be closed and opened at the front of the stage.

It is an object of the present invention to provide portable support devices and curtains for enclosing a stage. It is a further object to provide support devices which can be readily moved into place by unskilled persons and which can be compactly stored when not in use.

Other objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWING

Drawings accompany the disclosure and the various figures may be described as.

DETAILED DESCRIPTION OF THE INVENTION AND THE PRINCIPLES AND MANNER AND PROCESS OF USING IT

Figure 1:
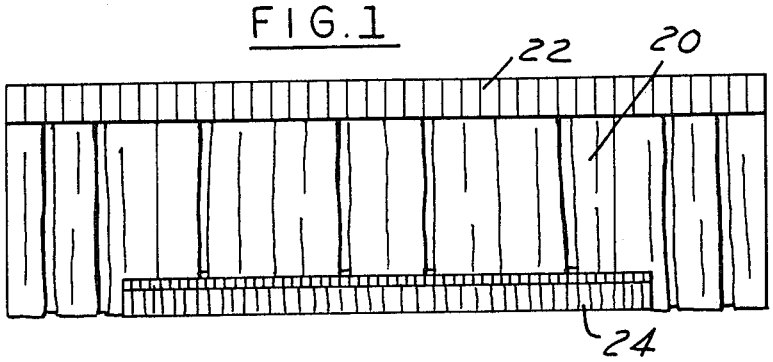
FIG. 1, a front view of a stage enclosure.
Figure 2:
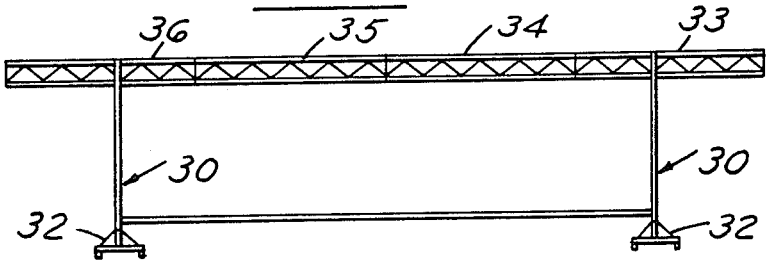
FIG. 2, a front elevation of a support assembly.
Figure 3:
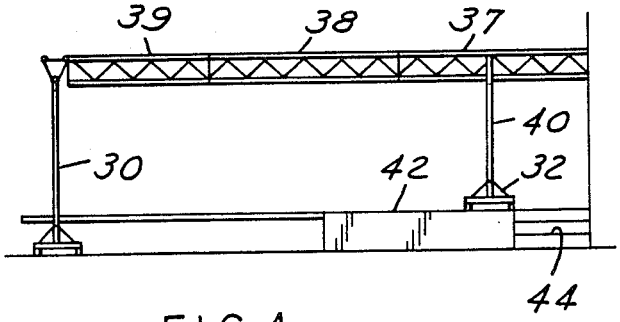
FIG. 3, a side view of a support assembly.

In FIG. 1, a front elevation of a stage is illustrated with a face curtain 20, a valence 22 and a stage panel drop skirt 24. In FIG. 2, spaced lift towers 30, each with a rollable base 32, are shown, connected at the top by spliced beams 33, 34, 35, 36 in the form of composite trusses. FIG. 3 illustrates a side view arrangement with three side truss lengths 37, 38 and 39. Also a lift tower

40 is shown with shorter length since the base is resting on a platform 42. Steps 44 provides access to the platform.

Figure 4:
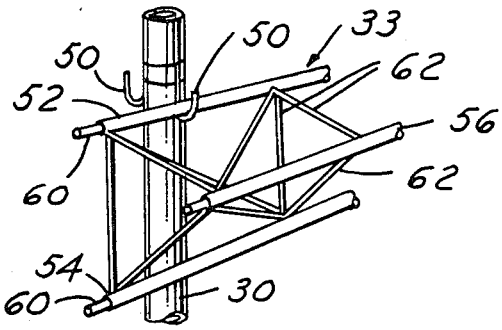
FIG. 4, a perspective view of a portion of a lift tower and a horizontal truss.

In FIG. 4, the lift tower 30 is illustrated with hooks 50 to carry a truss 33 in a storage position. The truss has three parallel rods 52, 54 and 56, each with an end projection 60 to be received in sockets in the respective end of an adjacent aligned truss. The rods 52, 54, 56 are disposed in a triangular frame arrangement by spaced connecting struts 62. The truss rod 52 is carried by the hook 50 on tower 30. The rod 54 bears against the tower 30 below rod 52. The truss rod 56 is thus spaced outwardly from the lift towers. This is a storage position as will be described. The rods and struts making up the trusses are preferably formed of a light metal such as aluminum or a light strong plastic so that the trusses can be readily handled by assemblers.

Figure 5:
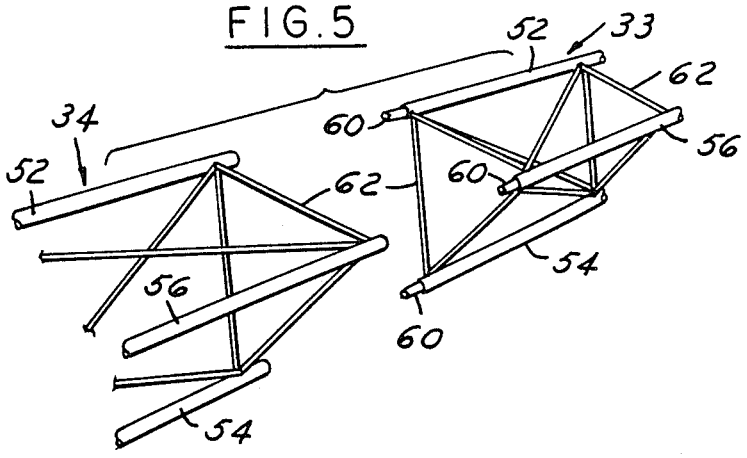
FIG. 5, a perspective view of truss ends.
Figure 6:
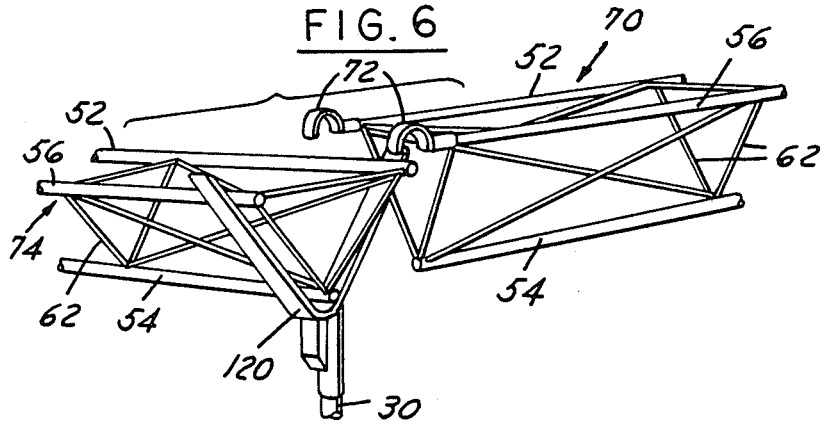
FIG. 6, a perspective view of trusses in angled relation.

In FIG. 5, trusses 33 and 34 are shown in a position to be engaged endwise. In FIG. 6, there is an illustration of connecting trusses at an angle. One truss 70 is provided with slip on hooks 72 which will hook over a truss rod 52 on a truss 74. These hooks can mount on projections 60.

Figure 7:
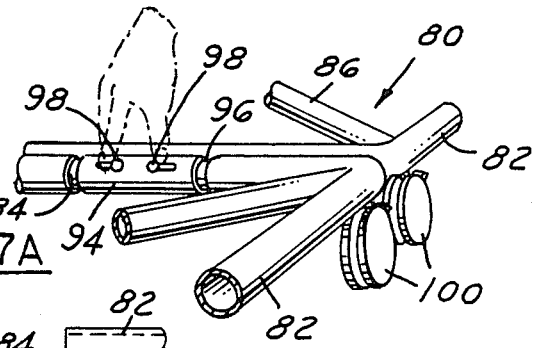
FIG. 7, a detailed view of a locking system for the base of lift towers.
Figure 8:
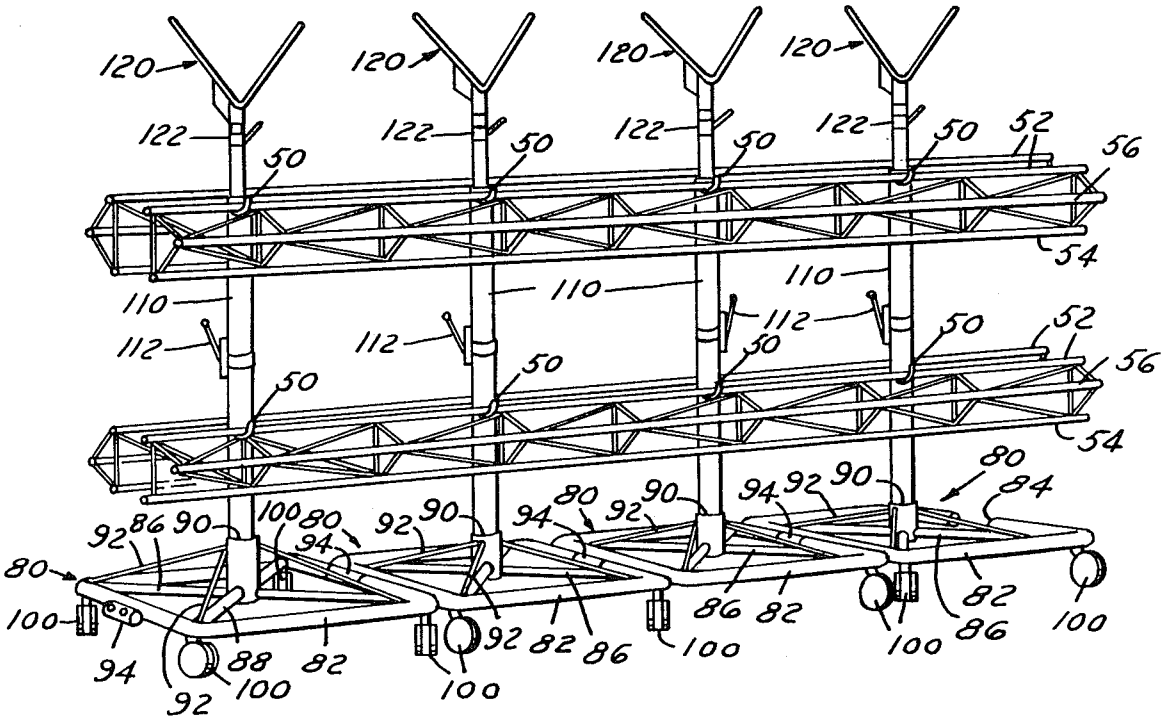
FIG. 8, perspective view of lift tower and trusses in storage position.

The lift towers 30 are shown in greater detail in FIG. 6, 7 and 8. A base frame 80 is formed from pipe 82 shaped in one plane in the form of a square with only a break 84 in one side run. Each base frame has diagonal struts 86, 88 which mount the base of a vertical, column 90, reinforced in its vertical position by angled struts 92. Each frame 80, has, on the side opposite the break 84, a short pipe section 94 at the same level as the break and dimensioned to fit into the break when frames 80 are brought into close juxtaposition as illustrated in FIG. 7. Each short section 94 has, at each end, a slip section 96 which will slide from within the section 94 to telescope into an open end of the break in the frame sections 82. These slip sections are manually movable by exposed slide buttons 98 from a recessed position to an engaged position in an adjacent frame.

Figure 7A:
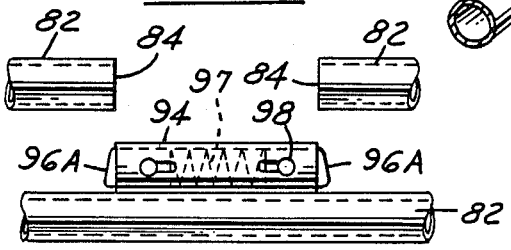
FIG. 7A, a view of a locking system with a latch in arrangement.

In FIG. 7A, a modified engagement structure is shown in which the short insert section 94 is provided with angled latch inserts 96A biased outwardly by a spring 97. With this construction, the insert 94 can be moved into the gap in the frame run 82 and locked into place by the spring latches. Release can be achieved by moving the external control buttons 98 toward each other against the bias of the spring 97.

In FIG. 8, four base sections 80 are shown interlocked so they can be moved as a unit.

Each base frame has roller castors 100 at each corner to facilitate positioning of the frame in a set up. Each vertical column 90, solidly mounted on the base 80, has a telescoping upper portion 110 which can be locked in an adjusted vertical position by level clamp 112. At the top of each upper portion 110 is a V-shaped saddle bracket 120 which can be rotated in any position and locked by a lever clamp 122. In FIG. 6, a truss is shown mounted in a V-bracket 120. The truss rods are thus disposed to carry curtains mounted with hooks on the outer rod 56. Curtains can be suspended around an entire stage unit with trusses disposed in front, on the sides, and the rear if desired.

For the front curtain a slide rope on a cable assembly can be provided to open and close the curtain as desired as a play or program progresses.

When a set-up is to be dismantled, winches can be used to lower the truss units and the curtains are removed and folded. The trusses are lifted off the V-brackets 120 and the lift towers are rolled together to the positions shown in FIG. 8, where the frames are locked together by the interfitting portions 94 and slide latches 96 or 96A. The trusses are then mounted on each side of the assembled lift towers by hooking them on the hooks 50 (FIG. 4). The curtains are then placed over the trusses. The entire storage assembly can then be rolled to a storage area and will occupy very little space when not in use, as, for example, 30 square feet.

The interlocked storage assembly can be loaded onto a truck for transport to another location or storage area. The curtain must be made of a fabric or other material which meets the strictest fire code regulations. The lift towers are preferably made of light weight material with each element weighing less than 40 pounds to facilitate assembly by unskilled persons. It is also preferable that each lift tower shall be less than 6 feet 7 inches in height to pass through a standard door opening.

The V-shaped saddle brackets 120 which support the triangular trusses are such that the trusses can adjust to different angles if the vertical lift on adjacent trusses is not always equal.

Figure 9:
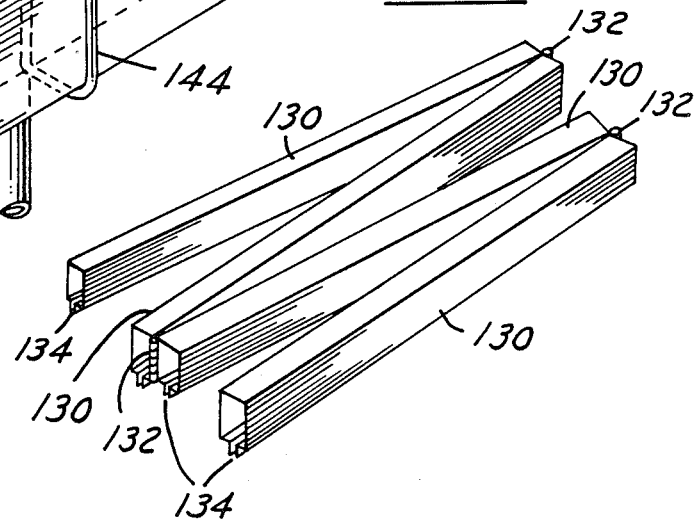
FIG. 9, a view of an optional tubular support.

In FIGS. 9 to 12, a modified embodiment of the invention is illustrated. In FIG. 9, four extruded sections 130 are hinged at 132 to enable the sections to form a long support beam to be mounted on support towers. The sections 130 are shown having a generally rectangular cross-section with track slots 134 in the lower surface to accept standard curtain carriers in sliding relation.

Figure 11:
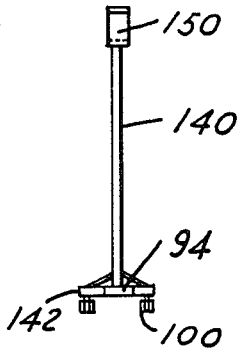
FIG. 11, a side view of a modified support tower.
Figure 12:
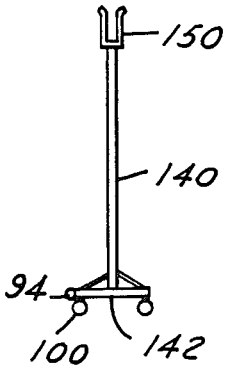
FIG. 12, an end view of the modified support tower.
Figure 10:
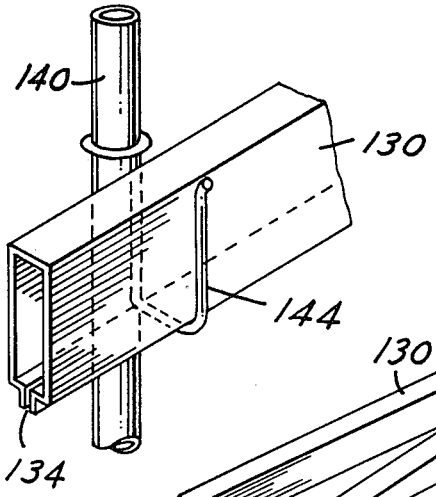
FIG. 10, a view of a modified support for a tubular beam.

In FIGS. 10, 11 and 12, support towers 140 are illustrated with a rolling base section 142 constructed as shown in FIGS. 7 and 8. In FIG. 10, a support hook 144 is shaped to receive the horizontal support section 130. In FIGS. 11 and 12, the tower stanchion 140 has a U-shaped receiving saddle bracket 150 also shaped to receive the rectangular supports. These towers would be used in the same manner as those previously described to support stage curtains.

What is claimed is:

1. A staging curtain support assembly which includes a plurality of portable towers, each tower comprising:

(a) a base frame having side edges, (b) a vertical support column mounted on said base frame, and (c) means on side edges of said base to intergage and interlock with adjacent base frames to permit said interlocked frames to be moved together as a unit for transport and storage, (d) said base frame being formed of a pipe shaped in a square and said means comprises a gap in said pipe on one edge of said square, and a short pipe section on another edge of an adjacent frame dimensioned to fit within said gap, and interlock means on said short pipe section to move into open ends of said pipe on each side of said gap to lock the adjacent frames together.

2. A staging curtain support assembly as defined in claim 1 in which saddle brackets are mounted atop each vertical support column, and at least one composite cross beam is shaped to rest in said saddle brackets of spaced support columns, said cross beam being formed as a truss with a plurality of parallel tubular horizontal runs connected by cross struts, and in which multiple trusses are aligned and each said truss has opposed ends with telescoping projections on one end and recesses at an opposite end to receive projections from an aligned truss.

3. A staging curtain support assembly as defined in claim 1 in which saddle brackets are mounted atop each vertical support column to support cross beams to rest in said saddle brackets, each said cross beam being formed as a truss with a plurality of tubular horizontal runs connected by cross struts, and in which multiple trusses may be disposed at an angle to each other, projections on at least one end of a truss, and hooks to mount on said projections at one end of a first truss to engage and receive support from a tubular horizontal run of a second truss disposed at an angle to said first truss.

4. A staging curtain support assembly as defined in claim 1 in which include a cross beam comprising a plurality of extruded sections hinged together to provide an extended beam, said sections having a longitudinally running slot to receive curtain slides.

5. A staging curtain support assembly as defined in claim 4 in which said extruded section is rectangular in crosssection and said slot is formed in the bottom side of said rectangle.

* * * * *

UNITED STATES PATENT AND TRADEMARK OFFICE

CERTIFICATE OF CORRECTION

PATENT NO. : 4,863,126

DATED : September 5, 1989

INVENTOR(S) : Orley D. Rogers and Kenneth E. Staten

It is certified that error appears in the above-identified patent and that said Letters Patent are hereby corrected as shown below:

Col. 4, Line 39, delete "in".

Col. 4, Line 39, change "include" to -- includes --.

Signed and Sealed this

Twenty-fourth Day of July, 1990

*Attest:*

HARRY F. MANBECK, JR.

*Attesting Officer*

*Commissioner of Patents and Trademarks*